US012672697B2

(12) United States Patent
Smith

(10) Patent No.: US 12,672,697 B2
(45) Date of Patent: Jul. 7, 2026

(54) DYNAMIC CUSHIONING SYSTEM FOR INSOLES

(71) Applicant: William L. Smith, Kent, WA (US)

(72) Inventor: William L. Smith, Kent, WA (US)

( * ) Notice: Subject to any disclaimer, the term of this patent is extended or adjusted under 35 U.S.C. 154(b) by 0 days.

(21) Appl. No.: 17/813,529

(22) Filed: Jul. 19, 2022

(65) Prior Publication Data

US 2024/0023667 A1 Jan. 25, 2024

(51) Int. Cl.
*A43B 13/18* (2006.01)
*A43B 17/02* (2006.01)

(52) U.S. Cl.
CPC ..... *A43B 13/189* (2013.01); *A43B 17/026* (2013.01)

(58) Field of Classification Search
CPC ... A43B 13/189; A43B 13/206; A43B 13/203; A43B 17/035; A43B 17/026; A43B 17/006; A43B 17/03; A43B 13/20
USPC ..... 36/29, 15, 14
See application file for complete search history.

(56) References Cited

U.S. PATENT DOCUMENTS 4,319,412 A * 3/1982 Muller ..... A43B 23/20 36/32 R
4,547,978 A * 10/1985 Radford ..... A43B 7/081 36/29
4,763,426 A * 8/1988 Polus ..... A43B 13/206 36/35 B
5,067,255 A * 11/1991 Hutcheson ..... A43B 17/026 36/43
5,179,792 A * 1/1993 Brantingham ..... A43B 13/203 36/71
5,950,332 A * 9/1999 Lain ..... A43B 17/035 36/35 B
6,453,577 B1 * 9/2002 Litchfield ..... A43B 13/203 36/35 B
6,754,981 B1 * 6/2004 Edwards ..... A43B 7/1445 36/3 R
7,966,749 B2 * 6/2011 Montross ..... A43B 13/20 36/35 B
11,950,655 B2 * 4/2024 Chang ..... A43B 7/144
2006/0026865 A1 * 2/2006 Grisoni ..... A43B 3/0057 36/43
2008/0216349 A1 * 9/2008 Wu ..... A43B 17/026 36/43

(Continued)

*Primary Examiner* — Alissa L Hoey
*Assistant Examiner* — Akwokwo Olabisi Redhead
(74) *Attorney, Agent, or Firm* — Barry L. Davison; Davis Wright Tremaine LLP

(57) ABSTRACT

Provided are dynamic cushioning systems (e.g., for use in insoles, orthoses, shoes, etc.), comprising: a fluid chamber (e.g., 100, 200) having at least one flexible fluid reservoir cell in each of a hindfoot and a forefoot portion, and having at least one main fluid transfer channel spanning a midfoot portion and connecting, in fluid exchange communication, the at least one hindfoot fluid reservoir cell with the at least one forefoot fluid reservoir cell to provide a reactive network of hindfoot and/or forefoot fluid reservoir cells in fluid exchange communication. The interconnected multi-reservoir networks provide optimal reactivity and dynamic positional cushioning by controlling fluid transfer rate(s) between and among the fluid reservoir cells. Also provided are methods for making the fluid chambers, along with insoles, orthoses, shoes, and other footwear, etc., comprising same.

16 Claims, 4 Drawing Sheets

(56) References Cited

U.S. PATENT DOCUMENTS

| | | | | |
|---|---|---|---|---|
| 2012/0291564 | A1* | 11/2012 | Amos | A43B 3/34<br>73/862.041 |
| 2018/0184750 | A1* | 7/2018 | Winger | A43B 17/035 |
| 2019/0000183 | A1* | 1/2019 | Mou | A43B 17/035 |
| 2022/0322789 | A1* | 10/2022 | Peregoy | A43B 17/026 |

* cited by examiner

DYNAMIC CUSHIONING SYSTEM FOR INSOLES

FIELD OF THE INVENTION

Aspects of the invention relate generally to cushioning systems including for shoes or components thereof (e.g., insoles, orthoses, etc.), more particularly to cushioning systems for insoles or orthotic devices (orthoses) for use in shoes and footwear, and even more particularly to dynamic (e.g., reactive) cushioning systems comprising a fluid (e.g., gel, etc.) chamber having at least one fluid-containing flexible reservoir cell in each of a forefoot portion and a hindfoot portion, and configured with at least one fluid transfer channel to provide for fluid exchange communication between the forefoot reservoir cell(s) and the hindfoot reservoir cell(s) of the fluid chamber, to provide for reactive cushioning during, walking, standing, running, etc.

BACKGROUND

Inserts (insoles) and orthotic devices (orthoses) in both rigid/functional or soft/accommodative forms for shoes are known in the art for providing cushioning and/or support in the context of various biomechanical foot issues with respect to walking, standing, running, etc., and may also help alleviate pain (e.g., foot, leg, thigh, and lower back pain) including that caused by medical conditions such as diabetes, plantar fasciitis, bursitis, and arthritis, etc.

Relative to rigid/functional orthoses, soft/accommodative orthoses are typically made of soft or semi-soft materials (e.g., cork, leather, plastic closed cell foams, and rubber materials), and thus are relatively bulky (e.g., often requiring special shoes to accommodate them), have relatively poor durability, and/or require frequent adjustments by a user or podiatrist.

Additionally, while traditional rigid or soft inserts and orthoses may provide cushioning elements at hindfoot, midfoot and/or forefoot positions, such cushioning elements are typically discontinuous or continuous. Traditional discontinuous cushioning elements comprise separate, positionally isolated and functionally independent cushioning elements, and thus do not communicate to cooperatively adjust cushioning between hindfoot and forefoot positions as the foot rolls forward during walking.

Traditional continuous cushioning elements, by contrast, typically comprise a single continuous heel-to-toe largely non-cooperative expanse of non-flowing cushion material, or a single heel-to-toe reservoir of a flowable cushioning material. While use of a single heel-to-toe reservoir of flowable cushioning material may provide for rapid heel-to-toe redistribution of a flowable cushioning material, such designs are not sufficiently nuanced to provide for achieving an optimal reactive and cooperative heel-to-toe balance between responsiveness (fluid transfer rate) and cushioning during walking, standing, running, etc.

There is, therefore, a long-standing need in the art for soft/accommodative inserts, and/or orthoses that not only provide balanced dynamic reactivity and cushioning between hindfoot and forefoot positions during walking, standing, running, etc., but also have less bulk, good durability, and don't require frequent adjustment.

SUMMARY OF EXEMPLARY EMBODIMENTS OF THE INVENTION

Figure 1:
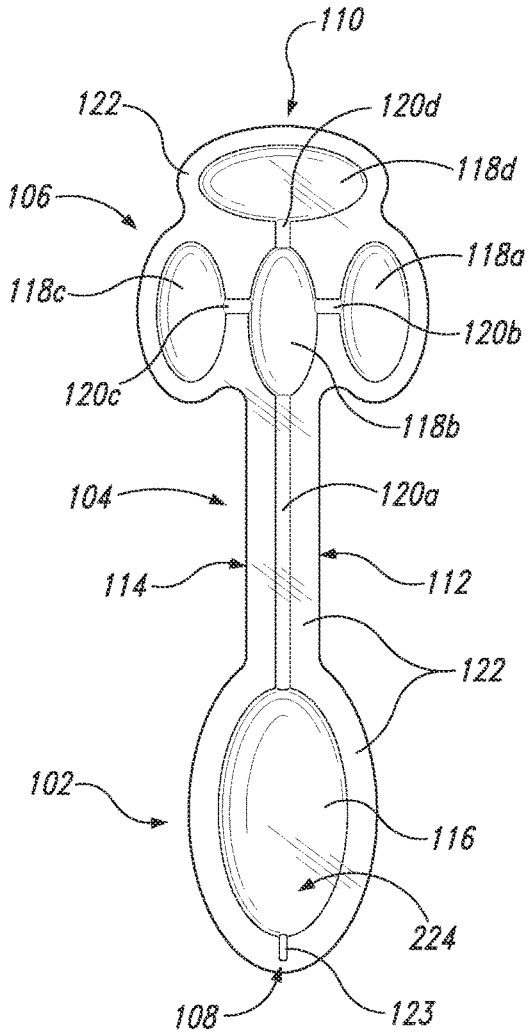
FIG. 1 shows, according to particular non-limiting aspects of the present invention, a top view of a first exemplary embodiment of a fluid (e.g., gel) chamber 100 of the present invention, comprising a hindfoot reservoir cell and four forefoot reservoir cells, the five cells being interconnected by fluid transfer channels, to provide a reactive network.

Embodiments of the disclosure can be described in view of the following clauses:

1. A cushioning system, comprising: a fluid chamber having top and bottom surfaces, hindfoot, midfoot and forefoot portions extending between a heel end and a toe end, and having a lateral (outer) side and a medial (inner) side; at least one flexible fluid reservoir cell in each of the hindfoot portion and the forefoot portion; and at least one main fluid transfer channel spanning the midfoot portion and connecting, in fluid exchange communication, the at least one flexible fluid reservoir cell in the hindfoot portion with the at least one flexible fluid reservoir cell in the forefoot portion.
2. The cushioning system of clause 1, wherein the at least one forefoot flexible fluid reservoir cell is positioned at or within a ball of the foot portion of the forefoot position of the fluid chamber.
3. The cushioning system of clause 1 or 2, wherein the top surface of the fluid chamber is flat or substantially flat, and wherein the bottom surface of the fluid chamber is contoured, extending downwardly away from the top surface.

4. The cushioning system of any one of clauses 1-3, wherein the fluid chamber comprises sealed margins defining the at least one hindfoot flexible fluid reservoir cell, and/or the at least one forefoot flexible fluid reservoir cell, and/or the at least one main fluid transfer channel.
5. The cushioning system of clause 4, wherein the top surface of the fluid chamber is substantially coplanar with the sealing margins, and wherein the bottom of the fluid chamber is contoured below the sealing margins by the walls of each of the at least one forefoot and/or hindfoot reservoir cells extending downwardly from the respective sealing margins.
6. The cushioning system of any one of clauses 1-5, wherein the forefoot portion comprises a plurality of forefoot fluid reservoir cells interconnected directly or indirectly by secondary forefoot fluid transfer channels to be in fluid exchange communication, such that the interconnected forefront fluid reservoir cells are, directly or indirectly, in fluid exchange communication with the at least one hindfoot fluid reservoir cell via the at least one main fluid transfer channel.
7. The cushioning system of clause 6, comprising at least two flexible fluid reservoir cells in the forefoot portion interconnected by at least one secondary forefoot fluid transfer channel, such that the at least two interconnected forefront fluid reservoir cells are, directly or indirectly, in fluid exchange communication with the at least one hindfoot fluid reservoir cell via the at least one main fluid transfer channel.
8. The cushioning system of clause 7, wherein the at least two forefoot fluid reservoir cells are positioned laterally between the lateral and medial sides of forefoot portion of the fluid chamber, and laterally interconnected by the at least one secondary forefoot fluid transfer channel.
9. The cushioning system of any one of clauses 6-8, wherein the forefoot portion comprises at least three to ten forefoot reservoir cells interconnected directly or indirectly by the secondary forefoot fluid transfer channels, such that the at least three interconnected forefront fluid reservoir cells are, directly or indirectly, in fluid exchange communication with the at least one hindfoot fluid reservoir cell via the at least one main fluid transfer channel.
10. The cushioning system of clause 9, wherein the hindfoot portion comprises a single hindfoot fluid reservoir cell, and wherein the forefoot portion comprises at least four forefoot fluid reservoir cells interconnected directly or indirectly by the forefoot fluid transfer channels, such that the at least four interconnected forefront fluid reservoir cells are, directly or indirectly, in fluid exchange communication with the at least one hindfoot fluid reservoir cell via the at least one main fluid transfer channel.
11. The cushioning system of clause 10, wherein three of the at least four interconnected forefoot fluid reservoir cells are positioned laterally between the lateral and medial sides of forefoot portion of the fluid chamber, and wherein one of the at least four interconnected forefoot fluid reservoir cells is positioned between the toe end of the fluid chamber and the three laterally disposed interconnected forefoot fluid reservoir cells within the forefoot portion.
12. The cushioning system of any one of clauses 1-11, wherein the fluid chamber comprises a single main fluid transfer channel spanning the midfoot portion.
13. The cushioning system of clause 11, wherein the fluid chamber comprises a single main fluid transfer channel spanning the midfoot portion and connecting directly to the central cell of the three laterally disposed interconnected forefoot fluid reservoir cells.
14. The cushioning system of clause 13, wherein the main fluid transfer channel spanning the midfoot portion branches to connect directly to each of the three laterally disposed interconnected forefoot fluid reservoir cells.
15. The cushioning system of clause 14, wherein the branches comprise two diagonal fluid transfer channels connecting the main fluid transfer channel directly to the outer cells of the three laterally disposed interconnected forefoot fluid reservoir cells.
16. The cushioning system of any one of clauses 1-15 wherein the combined volume (resting fluid capacity) of the at least one hindfoot fluid reservoir cell(s) is the same or smaller than the combined volume of the at least one forefoot fluid reservoir cell(s).
17. The cushioning system of any one of clauses 1-16, comprising a plurality of forefoot fluid reservoir cells of more than one volume.
18. The cushioning system of any one of clauses 1-17, further comprising a fluid.
19. The cushioning system of clause 18, wherein the fluid is a gel.
20. The cushioning system of clause 19, wherein the gel is a liquid silicone gel.
21. The cushioning system according to any one of clauses 1-20, as part of an insole or orthosis.
22. The cushioning system according to any one of clauses 1-21 as part of a shoe or other form of footwear.
23. The cushioning system of clause 22, wherein the shoe or the other form of footwear is selected from the group consisting of sneakers, athletic shoes, walking shoes, hiking shoes, and tennis shoes.
24. A method of making footwear, comprising incorporating a cushioning system according to any one of clauses 1-20 into an item of footwear.
25. The method of clause 24, comprising incorporating the cushioning system into an insole, orthosis, and/or shoe.
26. The method of clause 25, wherein incorporating comprises laminating the cushioning system in a molded cavity of an insole, orthosis or shoe portion.
26. A seat cushioning system, comprising: a fluid chamber having top and bottom surfaces, rearward, mid, and forward portions extending between a front end and a back end, and having a left side and a right side; at least one flexible fluid reservoir cell in each of the rearward portion and the forward portion; and at least one main fluid transfer channel spanning the mid portion and connecting, in fluid exchange communication, the at least one flexible fluid reservoir cell in the rearward portion with the at least one flexible fluid reservoir cell in the forward portion.
27. A cushioning system, comprising: a fluid chamber having top and bottom surfaces, hindfoot, midfoot and forefoot portions extending between a heel end and a toe end, and having a lateral (outer) side and a medial (inner) side; at least one flexible fluid reservoir cell in the hindfoot portion; at least two flexible fluid reservoir cells in the forefoot portion interconnected by at least one secondary forefoot fluid transfer channel; and at least one main fluid transfer channel spanning the midfoot portion and connecting, in fluid exchange communication, the at least one flexible fluid reservoir cell in the hindfoot portion with at least one of the at least two flexible fluid reservoir cells in the forefoot portion, such that the at least two interconnected forefront fluid reservoir cells are, directly or indirectly, in fluid exchange communication with the at least one hindfoot fluid reservoir cell via the at least one main fluid transfer channel to provide a reactive network.

28. The cushioning system of clause 1, wherein at least one of the at least two forefoot flexible fluid reservoir cell is positioned at or within a ball of the foot portion of the forefoot position of the fluid chamber.
29. The cushioning system of clauses 27 or 29, wherein the top surface of the fluid chamber is flat or substantially flat, and wherein the bottom surface of the fluid chamber is contoured, extending downwardly away from the top surface.
30. The cushioning system of any one of clauses 27-29, wherein the fluid chamber comprises sealed margins defining the at least one hindfoot flexible fluid reservoir cell, and/or the at least two forefoot flexible fluid reservoir cells, and/or the at least one main fluid transfer channel and/or the at least one secondary forefoot fluid transfer channel.
31. The cushioning system of clause 30, wherein the top surface of the fluid chamber is substantially coplanar with the sealing margins, and wherein the bottom of the fluid chamber is contoured below the sealing margins by the walls of each of the at least one hindfoot and/or the at least two forefoot reservoir cells extending downwardly from the respective sealing margins.
32. The cushioning system of any one of clauses 27-31, wherein the at least two forefoot fluid reservoir cells are positioned laterally between the lateral and medial sides of forefoot portion of the fluid chamber, and laterally interconnected by the at least one secondary forefoot fluid transfer channel.
33. The cushioning system of any one of clauses 27-32, wherein the forefoot portion comprises at least three to ten forefoot reservoir cells interconnected directly or indirectly by a plurality of the secondary forefoot fluid transfer channels, such that the at least three interconnected forefront fluid reservoir cells are, directly or indirectly, in fluid exchange communication with the at least one hindfoot fluid reservoir cell via the at least one main fluid transfer channel.
34. The cushioning system of clause 33, wherein the hindfoot portion comprises a single hindfoot fluid reservoir cell, and wherein the forefoot portion comprises at least four forefoot fluid reservoir cells interconnected directly or indirectly by the forefoot fluid transfer channels, such that the at least four interconnected forefront fluid reservoir cells are, directly or indirectly, in fluid exchange communication with the at least one hindfoot fluid reservoir cell via the at least one main fluid transfer channel.
35. The cushioning system of clause 34, wherein three of the at least four interconnected forefoot fluid reservoir cells are positioned laterally between the lateral and medial sides of forefoot portion of the fluid chamber, and wherein one of the at least four interconnected forefoot fluid reservoir cells is positioned between the toe end of the fluid chamber and the three laterally disposed interconnected forefoot fluid reservoir cells within the forefoot portion.
36. The cushioning system of any one of clauses 27-35, wherein the fluid chamber comprises a single main fluid transfer channel spanning the midfoot portion.
37. The cushioning system of clause 35, wherein the fluid chamber comprises a single main fluid transfer channel spanning the midfoot portion and connecting directly to the central cell of the three laterally disposed interconnected forefoot fluid reservoir cells.
38. The cushioning system of clause 37, wherein the main fluid transfer channel spanning the midfoot portion branches to connect directly to each of the three laterally disposed interconnected forefoot fluid reservoir cells.
39. The cushioning system of clause 38, wherein the branches comprise two diagonal fluid transfer channels connecting the main fluid transfer channel directly to the outer cells of the three laterally disposed interconnected forefoot fluid reservoir cells.
40. The cushioning system of any one of clauses 27-39 wherein the combined volume (resting fluid capacity) of the at least one hindfoot fluid reservoir cell(s) is the same or smaller than the combined volume of the at least two forefoot fluid reservoir cell(s).
41. The cushioning system of any one of clauses 27-40, comprising a plurality of forefoot fluid reservoir cells of more than one volume.
42. The cushioning system of any one of clauses 27-41, further comprising a fluid.
43. The cushioning system of clause 42, wherein the fluid is a liquid silicone gel.
44. The cushioning system according to any one of clauses 27-43, as part of an insole, orthosis, shoe or other form of footwear.
45. A method of making footwear, comprising incorporating a cushioning system according to any one of clauses 27-43 into an item of footwear.
46. The method of clause 45, wherein incorporating comprises laminating the cushioning system into an insole, orthosis, shoe, or other form of footwear.
47. A seat cushioning system, comprising: a fluid chamber having top and bottom surfaces, rearward, mid and forward portions extending between a front end and a back end, and having a left side and a right side; at least one flexible fluid reservoir cell in the rearward portion; at least two flexible fluid reservoir cells in the forward portion interconnected by at least one secondary forward fluid transfer channel; and at least one main fluid transfer channel spanning the mid portion and connecting, in fluid exchange communication, the at least one flexible fluid reservoir cell in the rearward portion with at least one of the at least two flexible fluid reservoir cells in the forward portion, such that the at least two interconnected forward fluid reservoir cells are, directly or indirectly, in fluid exchange communication with the at least one rearward fluid reservoir cell via the at least one main fluid transfer channel to provide a reactive network.

DETAILED DESCRIPTION OF EXEMPLARY EMBODIMENTS

Aspects of the present invention provide dynamic (e.g., reactive) cushioning systems, comprising a multi-reservoir fluid chamber (e.g., multi-reservoir fluid envelop) having at least one interconnecting fluid transfer channel for connecting and regulating fluid transfer rate between and among a network of reservoir cells, and methods for making same. The cushioning systems have broad applications, including particular exemplary applications presented herein, which are not intended to limit the scope of the invention.

Particular exemplary embodiments provide cushioning systems for shoes or components thereof (e.g., insoles, and/or orthoses), that not only provide optimally balanced dynamic reactivity and cushioning between hindfoot and forefoot positions during walking, standing, running, etc., but also have less bulk, good durability, and don't require frequent adjustment.

Figure 2:
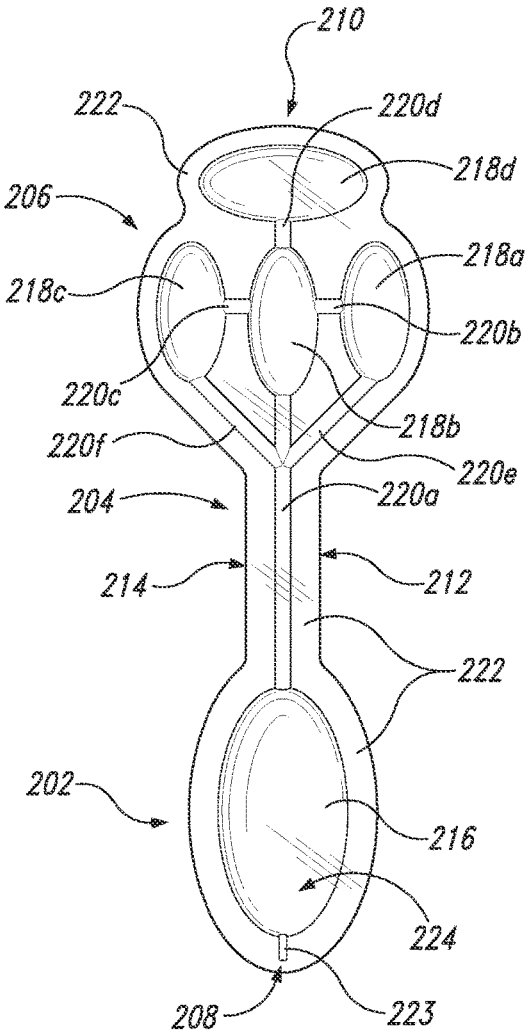
FIG. 2 shows, by way of a further non-limiting example of the present invention, a top view of an alternative embodiment of a fluid (e.g., gel) chamber 200 of the present invention, comprising a hindfoot reservoir cell and four forefoot reservoir cells, the five cells being interconnected by fluid transfer channels including (relative to the embodiment of FIG. 1) two additional diagonal fluid transfer channels to provide a reactive network.

In reference to FIGS. 1-3, the cushioning systems for shoes or components thereof comprise a flexible, generally elongated fluid chamber/envelope 100, 200 (e.g., gel chamber) having top 224 and bottom 226 surfaces defining hindfoot 102, 202, midfoot 104, 204 and forefoot 106, 206 portions, and having at least one main fluid transfer channel 120*a*, 220*a* spanning the midfoot portion and connecting, in fluid exchange communication, at least one flexible hindfoot reservoir cell (pod) 116, 216 in the hindfoot portion with at least one flexible forefoot reservoir cell 118*a-d*, 218*a-d* in the forefoot portion. The at least one main fluid transfer channel 120*a*, 220*a* may serve to connect directly or indirectly to any number of interconnected flexible reservoir cells that may be positioned in each of the hindfoot 102, 202 and/or the forefoot 106, 206 portions of the fluid chamber 100, 200. Particular exemplary fluid chamber embodiments 100, 200, for example, comprise a single hindfoot reservoir cell 116, 216 connected, in fluid exchange communication via a main fluid transfer channel 120*a*, 220*a*, to at least one (e.g., 118*b*, 218*a-c*) of multiple flexible forefoot reservoir cells 118*a-d*, 218*a-d*, which are in turn interconnected, directly or indirectly, by secondary fluid transfer channels 120*b-d*, 220*b-d* such that all of the reservoir cells (e.g., both hindfoot 116, 216 and forefoot reservoir cells 118*a-d*, 218*a-d*) are interconnected, directly or indirectly, in dynamic fluid exchange communication.

The hindfoot 116, 216 and forefoot reservoir cells 118*a-d*, 218*a-d* and/or the main 120*a*, 220*a* and/or the secondary transfer channels 120*b-d*, 220*b-d*, and/or the branching diagonal fluid transfer channels 220*e* and 220*f* may be constructed and defined by sealed/sealing margins 122, 222 between the top surface 224 and the bottom surface 226 of the fluid chamber 100, 200. In preferred embodiments, the top surface 224 of the fluid chamber 100, 200, including the tops of the respective reservoir cells 116, 118*a-d* and 216, 218*a-d* and transfer channels 120*a-d* and 220*a-f*, is essentially flat and substantially coplanar with the respective sealing margins 122 and 222, whereas the bottom 226 of the fluid chamber 100, 200 is contoured below the sealing margins 122, 222 by curved walls of each of the reservoir cells 116, 118*a-d* and 216, 218*a-d* extending downwardly in rounded or curved fashion from the respective sealing margins 122, 222, forming an ovoid bottom of each respective reservoir cell. Likewise, the walls of each of the transfer channels 120*a-d* and 220*a-f* may and preferably do extend downwardly (in curved fashion) from the respective sealing margins 122 and 222, forming tubular bottoms of the transfer channels.

In further reference to FIGS. 1-3, particular fluid chamber embodiments (as in the First and Second exemplary fluid chamber embodiments 100 and 200, described in more detail below) comprise a single flexible hindfoot reservoir cell 116, 216 connected, in fluid exchange communication via a main fluid transfer channel 120*a*, 220*a*, to at least one of four flexible forefoot reservoir cells 118*a-d*, 218*a-d*, which four forefoot reservoir cells are interconnected by secondary fluid transfer channels 120*b-d*, 220*b-d* such that all five reservoir cells (both hindfoot and forefoot) are interconnected, directly or indirectly, in fluid exchange communication. In preferred embodiments (FIGS. 2 and 3, the fluid chamber 200 comprises a single flexible hindfoot reservoir cell 216 connected, in fluid exchange communication via a main fluid transfer channel 220*a* and two branching diagonal fluid transfer channels 220*d* and 220*e*, to three 218*a-c* of four flexible forefoot reservoir cells, which four forefoot reservoir cells 218*a-d* are interconnected by secondary fluid transfer channels 220*b-d* such that all five reservoir cells (both hindfoot 216 and forefoot 218*a-d*) are interconnected, directly or indirectly, in fluid exchange communication.

According to particular fluid chamber aspects of the present invention, relative to use of a single heel-to-toe fluid reservoir cell (e.g., in construction of an insole or orthosis), use of at least one hindfoot reservoir cell connected to a least one forefoot reservoir call via at least one main fluid transfer channel, provides for balanced dynamic reactivity and cushioning between hindfoot and forefoot positions during walking, standing, running, etc. According to further fluid chamber aspects of the present invention, connecting at least one hindfoot reservoir cell, via a main transfer channel, to at least one of a plurality of forefoot fluid reservoirs cells that are, in turn, interconnected by secondary fluid transfer channels, not only provides for optimal balanced dynamic reactivity and cushioning between hindfoot and forefoot positions during walking, standing, running, etc., but also provides for more targeted pressure relief under the heads of the different metatarsal bones. In the devices and methods of the invention, the use of main and/or secondary and/or branching (e.g., diagonal) fluid transfer channels to interconnect hindfoot and forefoot reservoir cells provides a mechanism to balance reactivity and cushioning by dynamically regulating the fluid transfer rate over a network of interconnected reservoir cells.

The exemplary fluid chambers 100, 200 (both the flexible reservoir cells and the main and secondary transfer channels, including any branching channels) may be made of one or more suitable flexible material(s) (e.g., thermoplastic polyurethane, thermoplastic elastomers, other suitable block copolymer having hard and soft segments, etc.). The fluid chambers 100, 200, etc., may, for example, be made from a single material that is both flexible and resilient. Preferably, the fluid chambers 100, 200, etc. (including the reservoir cells and the transfer channels) are made from a single material (e.g., thermoplastic polyurethane (TPU), e.g., from BP) that is flexible, resilient and sufficient transparent to provide for viewing of contents of the fluid chambers 100, 200, etc.

In operative embodiments (e.g., insoles, orthoses, etc.), the fluid chambers 100, 200, contain a fluid (e.g., air, gas, liquid, gel, etc.) transferable between and among the flexible hindfoot 116, 216 and/or flexible forefoot reservoir cells 118*a-d*, 218*a-d* via the main 120*a*, 220*a* and/or secondary fluid transfer channels 120*b-d*, 220*b-f*. Preferably the fluid is or comprises a gel (e.g., liquid silicone gel, etc.). Preferably, the fluid is or comprises a clear or translucent fluid (e.g., liquid silicone gel, etc.). More preferably, the fluid is or comprises a clear or translucent fluid (e.g., liquid silicone gel, etc.) containing an indicator agent (e.g., a colorimetric, fluorescent, chromogenic, etc., agent) to aid visualization of fluid transfer dynamics of the fluid chambers 100, 200, etc. In operation, the fluid chambers 100, 200 provide reactive cushioning during walking, standing, running, etc. For example, when a user steps on the flexible hindfoot reservoir cell 116, 216 of fluid respective fluid chamber 100, 200, the fluid in the hindfoot reservoir cell(s) 116, 216 absorbs shock and is forced through the main 120*a*, 220*a* and any secondary or branching transfer channels 120*b-d*, 220*b-f* to and among the forefoot reservoir cell(s) 118*a-d*, 218*a-d*. As the foot then rolls forward, the fluid (e.g., gel) is forced back from the forefoot reservoir cell(s) 118*a-d*, 218*a-d* through the various transfer channels to the hindfoot reservoir cell 116-216 for the next step. The exemplary fluid chambers 100, 200 thus provide for reactive cushioning by transferring/distributing fluid, and hence cushioning, between a network of hindfoot and forefoot reservoirs in response to the pressure dynamics exerted on the fluid chambers 100, 200 during walking, standing running, etc. Moreover, as stated above, relative to use of a single forefoot fluid reservoir cell, use of a plurality of interconnected forefoot fluid reservoirs cells in the fluid chambers of the invention not only provides for balanced dynamic reactivity and cushioning, but also for more targeted pressure relief under the heads of the different metatarsal bones.

According to additional aspects of the present invention, various factors may affect the reactivity (fluid transfer rate(s) between and among fluid reservoir cells) and degree of cushioning provided. For example, fluid viscosity, fluid chamber fill levels (% resting capacity (not stretched)), fluid transfer channel diameters and/or orientation, reservoir cell size, reservoir cell wall curvature and/or shape and/or elasticity, relative number and/or distribution/orientation of hindfoot and forefoot reservoir cells and/or transfer channels, etc., may individually and/or in any combination or collectively contribute to optimal reactivity and degree of cushioning. In this regard, for example, the flexible fluid chambers 100, 200 may be filled to any level of resting fluid capacity (i.e., how much gel the gel chamber can hold without stretching) sufficient to provide for adequate fluid transfer rates and cushioning. For example, the resting fluid chamber 100, 200, etc., (i.e., the respective reservoir cells and the transfer channels, collectively) may be filled, for example, to any fill level value (% capacity) in a range of from about 50% to about 95%, about 60% to about 90%, about 70% to about 85%, or about 80 to about 85% of fill capacity, provided that the fill level is sufficient to provide for adequate fluid transfer rates and cushioning during operative use of the fluid chambers 100, 200, etc. Using, for example, gel (e.g., liquid silicone gel) as the fluid and a fluid transfer channel diameter of 0.7 mm for both main 120*a*, 220*a* and secondary or branched 120*b-d*, 220*b-f* fluid transfer channels, the resting flexible fluid chamber 100, 200 is optimally filled to about 85% capacity (e.g., with the resting fluid chamber lying flat, the gel being distributed throughout all the reservoir cells and fluid transfer channels) to provide optimal cushioning and transfer rate. In operation, using such an 85% capacity fill level with gel, for example, upon initial heel strike pressure some of the gel in the flexible hindfoot reservoir cell 116, 216 is forced into and through the main 120*a*, 220*a* and secondary or branched 120*b-d*, 220*b-f* fluid transfer channels into the flexible forefoot reservoir cells 118*a-d*, 218*a-d*, and as the heel strike is completed, the majority of the rest of the gel in the flexible hindfoot reservoir cell 116, 216 is transferred to and among the flexible forefoot reservoir cells 118*a-d*, 218*a-d*, leaving the hindfoot reservoir cell 116, 216 essentially empty after the completed heel strike. As the foot rolls forward, gel is redistributed (e.g., by increased forefoot pressure) from the forefoot reservoir cells back through the secondary or branched 120*b-d*, 220*b-f* and main fluid transfer channels 120*a*, 220*a* to the hindfoot reservoir cell 116, 216 to provide optimal cushioning for the next step. In response to dynamic foot pressure distribution (e.g., during walking standing, running, etc.), the disclosed exemplary fluid chambers 100, 200 thus provide continuous, reactive distribution of gel between hindfoot and forefoot fluid reservoirs as needed for optimal dynamic cushioning. Resting fill levels greater than about 85% (e.g., 90-100%) resulted in decreased reactivity/responsiveness due to sub-optimal fluid transfer between hindfoot and forefoot reservoir cells, whereas resting fill levels less than about 85% (e.g., 50-70%) resulted in sub-optimal cushioning.

As stated above, the various factors described above may act individually and/or in any combination or collectively contribute to optimal reactivity (fluid transfer rate(s) between and among fluid reservoir cells) and degree of cushioning. For example, increasing the diameter of the transfer channels 120*a-d*, 220*a-f* to values greater than 0.7 mm may require use of higher fill levels (e.g., greater than 85% resting capacity) to achieve adequate performance, whereas decreasing the diameter of the transfer channels 120*a-d*, 220*a-f* to values less than 0.7 mm may reduce the fluid transfer rate, impacting the cushioning.

With respect to the contour of the bottom surface of the fluid chambers 100, 200, etc., (i.e., with respect to the shape of the reservoir cell wall extending downwardly from the sealing margins 122, 222), it was empirically determined that having rounded walls of the hindfoot 116, 216 and forefoot 118*a-d*, 218*a-d* reservoir cells provided more optimal fluid transfer rates in and out of the reservoir cells. While not being bound by mechanism, this may reflect improved flow characteristic provided by a curved surface compared to an abruptly angled surface (e.g., akin to the reduced energy losses seen in curved vs 90° tee junctions in fluid pipes, due to a reduction in the branching flow loss coefficient; *Journal of Fluid Engineering*, April 2006, 128 (6) DOI:10.1115/1.234524).

In preferred exemplary fluid chamber embodiments, with respect to relative number and distribution of transfer channels, it was empirically determined that providing fluid transfer channel branches from the main fluid transfer channel 120*a*, 220*a* to directly connect to more than one of the forefoot reservoir cells further improves the speed/responsiveness of the fluid transfer rate of the fluid chambers 100, 200, etc. For example, in the Second exemplary fluid chamber embodiment 200, discussed in greater detail below, branching of the main fluid transfer channel 220*a* with two additional diagonal fluid transfer channels 220*e* and 220*f*, provides for directly connecting the main fluid transfer channel 220*a* to three 218*a-c* of the four 218*a-d* forefoot reservoirs cells, resulting in more consistent and improved speed/responsiveness of the fluid transfer rate.

Moreover, as stated above, relative to use of a single forefoot fluid reservoir cell, use of a fluid reservoir cell network including a plurality of interconnected forefoot fluid reservoirs cells in the fluid chambers of the invention not only provides for balanced dynamic reactivity and cushioning, but also for more targeted pressure relief under the heads of the different metatarsal bones.

Definitions

The term "volume" or "fill capacity", as used herein in relation to the fluid chambers (including hindfoot and/or forefoot fluid reservoir cells, and all interconnecting transfer channels) refers to the resting (unstretched) fill capacity (volume) of the fluid chambers (including hindfoot and forefoot fluid reservoir cells, and transfer channels).

The term "fill level", as used herein, refers to fill level in terms of percentage (%) of the resting (unstretched) volume or fill capacity of the fluid chambers (including hindfoot and forefoot fluid reservoir cells, and transfer channels). For example, a fluid chamber (e.g., 100, 200) having a fill level of 85%, means that the fluid chamber is filled to 85% of the resting (not stretched) volume or fill capacity of the fluid chamber (including hindfoot and forefoot fluid reservoir cells, and transfer channels).

In the multi-reservoir cell fluid chambers of the invention (e.g., 100, 200, etc.), the term "fluid transfer channel" refers, unless stated otherwise, to a fluid transfer channel connecting two fluid reservoir cells in fluid exchange communication. A "main fluid transfer channel" connects at least one hindfoot fluid reservoir cell(s) with at least one forefoot fluid reservoir cell(s). A "secondary forefoot fluid transfer channel" interconnects two forefoot fluid reservoir cells. A "secondary hindfoot fluid transfer channel" interconnects two hindfoot fluid reservoir cells. A fluid transfer channel may have one or more "branches" (e.g., diagonal, lateral, etc.) to enable the fluid transfer channel to either: connect directly to more than one fluid reservoir cell (e.g., a main fluid transfer channel may have one or more branches to provide direct interconnections to more than one forefoot fluid reservoirs cells); and/or to interconnect at more than one connecting points of a fluid reservoir cell. In the fluid chambers of the invention (e.g., 100, 200, etc.), multiple fluid transfer channels may serve to interconnect, directly or indirectly, multiple hindfoot and/or forefoot fluid reservoir cells to be in fluid exchange communication-forming a dynamic network of hindfoot and/or forefoot fluid reservoir cells in fluid exchange communication. Such networks provide for designing and/or tailoring the reactivity (fluid transfer rate) and/or dynamic positional cushioning during use of the fluid chambers (e.g., 100, 200, etc.) and cushioning systems of the invention.

The term "reactivity", as used herein, refers to the fluid transfer rate(s) between and/or among fluid reservoir cells (e.g., including the main, secondary, and any branch (e.g., diagonal branches) fluid transfer channels).

The term "positional cushioning" or "dynamic positional cushioning", as used herein, refers to the temporal dynamic positioning of fluid, and hence cushioning, distributed between and among the interconnected fluid reservoir cells (fluid reservoir cell network), during use of the multi-reservoir fluid chambers.

The "ball of the foot" or "ball", as used herein, refers to the padded portion of the sole between the toes and the arch, underneath the heads of the metatarsal bones.

The "forefoot", as used herein, refers to the region of the foot consisting of the toe bones (phalanges), and metatarsal bones. The Phalanges connect to metatarsals at the ball of the foot by joints called phalange metatarsal joints.

The "midfoot", as used herein, refers to the portion of the foot between the hindfoot and forefoot, and is composed of the cuboid, navicular and cuneiform bones[1]. The mid-tarsal joint (Chopart joint) joins the hindfoot to the midfoot. The tarsometatarsal joints (TMTJ) joins the midfoot to the forefoot.

The "hindfoot", as used herein, refers to the portion of the foot including of the talus bone and the calcaneum. The talus connects with the tibia and fibula to form the ankle joint, and the calcaneum is the bone that forms the heel bone.

FIGS. 1-6 show exemplary embodiments of dynamic (e.g., reactive, cooperative) cushioning systems according to exemplary aspects of the present invention.

First Exemplary Fluid Chamber Embodiment

With reference to FIGS. 1-3, FIG. 1 shows a top view of a first exemplary embodiment of a fluid (e.g., gel) chamber 100 of the present invention, comprising hindfoot 102, midfoot 104 and forefoot 106 portions extending, in a generally planar configuration, between a heel end 108 and a toe end 110, and between a lateral (outer) side 112 and a medial (inner) side 114. While there may be one or more flexible reservoir cell(s) in each of the hindfoot portion 102 and the forefoot portion 106 of the fluid chamber 100, in this embodiment there is a single ovoid flexible hindfoot reservoir cell 116 and four ovoid flexible forefoot reservoir cells **118*a*-118*d*, the five flexible reservoir cells being interconnected by a main fluid transfer channel 120*a* and three secondary fluid transfer channels 120*b*-120*d*. In this embodiment, the volume (fill capacity) of the hindfoot reservoir cell 116 is somewhat smaller than the combined volume (fill capacity) of the forefoot reservoir cells 118*a*-118*d*. The borders of the flexible reservoir cells and the interconnecting fluid transfer channels are defined by sealed margins 122, sealing between a top surface and a bottom surface of the fluid chamber 100 defining the contours of the fluid chamber 100. In this first exemplary embodiment, all of the transfer channels, both main 120*a* and secondary 120*b*-120*d*, are 7 mm wide, while the sealing margins 122 are 5 mm wide, the sealing margins 122 defining a perimeter of the fluid chamber 100**.

Other transfer channel diameters and sealing margin widths may be used in the fluid chambers of the invention. Transfer channel diameters may, for example be any value between 5 mm and 20 mm, between 5 mm and 15 mm, between 5 mm and 10 mm, or other suitable or larger value. Sealing margin widths may, for example be any value between 2 mm and 20 mm, between 3 mm and 20 mm, between 4 mm and 20 mm, 2 mm and 10 mm, 3 mm and 10 mm, 4 mm and 10 mm, or other suitable or larger value. Transfer channel diameter and/or sealing margin widths may vary within a particular fluid chamber to further tailor the reactivity and cushioning dynamics. Transfer channel diameter and/or sealing margin widths may be constant and/or vary (e.g., taper, steps, etc.) within one, several or all transfer channel(s) and/or sealing margin(s), respectively, within a particular fluid chamber to further tailor the reactivity and cushioning dynamics.

While not readily apparent in the top view of FIG. 1, the top of the fluid chamber 100, including the tops of the reservoir cells and transfer channels, is essentially flat and substantially coplanar with the sealing margins 122, whereas the bottom of the fluid chamber 100 is contoured below the sealing margins 122 by the walls of each of the five reservoir cells extending downwardly (in rounded or curved fashion) from the respective sealing margins 122, forming an ovoid bottom (e.g., a bottom extending downwardly from the respective margin 122 and having curved or rounded edges near the sealing margins 122) of each of the five reservoir cells (more clearly visualized in relation to FIGS. 3A and 3B discussed below). Likewise, the walls of each of the transfer channels extend downwardly (in curved fashion) from the respective sealing margins 122, forming **1*s*** tubular bottoms of the transfer channels.

Forefoot reservoir cells **118*a*-118*c* are the same or substantially the same volume (fill capacity) and laterally spaced between the lateral 112 and medial side 114, while the forefoot reservoir cell 118***d* is somewhat larger in volume and is positioned between the toe end 110 and the three laterally disposed forefoot reservoir cells 118*a*-118*c*. In this embodiment, the long dimensions of the ovoid hindfoot 116 and forefoot reservoir cells 118*a*-118*c* are longitudinally disposed between the heel end 108 and a toe end 110, whereas the long dimension of ovoid forefoot reservoir cell 118*d* is laterally disposed between the lateral (outer) side 112 and a medial (inner) side 114 of the fluid chamber 100. Use of a plurality of interconnected forefoot fluid reservoirs cells in the fluid chambers of the invention not only provides for balanced dynamic reactivity and cushioning, but also for more targeted pressure relief under the heads of the different metatarsal bones. According to additional aspects, targeted pressure relief is further nuanced by having the long dimension of ovoid forefoot reservoir cell 118*d* laterally disposed under the toe region between the lateral side 112 and a medial side 114 of the fluid chamber 100.

The main fluid transfer channel 120*a* longitudinally spans the midfoot portion 104 connecting, in fluid exchange communication, the hindfoot reservoir cell 116 with the central forefoot reservoir cell 118*b*, which in turn is also connected in fluid exchange communication to forefoot reservoir cells 118*a*, 118*c* and 118*d* via secondary transfer channels 120*b*, 120*c* and 120*d*, respectively, the transfer channels collectively connecting (directly or indirectly) all five fluid reservoir cells in fluid exchange communication.

In this embodiment, the fluid chamber 100 contains a suitable fluid introducible via a fluid fill port 123 into the hindfoot reservoir cell 116 at or near the heel end 108, the fill port 123 then being sealed within the sealing margin 122. Since the hindfoot and forefoot reservoir cells are interconnected in fluid exchange communication, the positioning of the fluid fill port could be into any one of the reservoir cells, or there may be multiple fluid fill ports positioned in or among one or more reservoirs cells, and in each case sealable by respective sealing margin(s). In this embodiment, the fill level of the fluid chamber (including all five of the fluid reservoir cells and transfer channels) is about 85% of the resting (not stretched) fill capacity.

In this embodiment, the fluid chamber 100 is constructed from a transparent thermal polyurethane (TPU), such that the reservoir cells, transfer channels, and any contents thereof are visible. Any suitably flexible resilient material, preferably transparent, may be used.

Second Exemplary Fluid Chamber Embodiment

With reference to FIGS. 1-3, FIG. 2 shows a top view of a second exemplary embodiment of a fluid (e.g., gel) chamber 200 of the present invention, comprising hindfoot 202, midfoot 204 and forefoot 206 portions extending, in a generally planar configuration, between a heel end 208 and a toe end 210, and between a lateral (outer) side 212 and a medial (inner) side 214. As in the First exemplary embodiment, while there may be one or more flexible reservoir cell(s) in each of the hindfoot portion 202 and the forefoot portion 206 of the fluid chamber 200, in this embodiment there is a single ovoid flexible hindfoot reservoir cell 216 and four ovoid flexible forefoot reservoir cells 218*a*-218*d*, the five flexible reservoir cells being interconnected by a main fluid transfer channel 220*a*, three secondary fluid transfer channels 220*b*-220*d*, and two diagonal fluid transfer channels 220*e* and 220*f* that branch from fluid transfer channel 220*a*. In this embodiment, the volume (fill capacity) of the hindfoot reservoir cell 216 is somewhat smaller than the combined volume (fill capacity) of the forefoot reservoir cells 218*a*-218*d*. The borders of the flexible reservoir cells and the interconnecting fluid transfer channels are defined by sealed margins 222, sealing between a top surface 224 and a bottom surface 226 of the fluid chamber 200 defining the contours of the fluid chamber 200. In this second exemplary embodiment, all of the transfer channels (main 220*a*, secondary 220*b*-220*d*, and diagonal 220*e*, 220*f*, are 7 mm wide, while the sealing margins 222 are 5 mm wide, the sealing margins 222 defining a perimeter of the fluid chamber 200.

Other transfer channel diameters and sealing margin widths may be used in the fluid chambers of the invention. Transfer channel diameters may, for example be any value between 5 mm and 20 mm, between 5 mm and 15 mm, between 5 mm and 10 mm, or other suitable or larger value. Sealing margin widths may, for example be any value between 2 mm and 20 mm, between 3 mm and 20 mm, between 4 mm and 20 mm, 2 mm and 10 mm, 3 mm and 10 mm, 4 mm and 10 mm, or other suitable or larger value. Transfer channel diameter and/or sealing margin widths may vary within a particular fluid chamber to further tailor the reactivity and cushioning dynamics. Transfer channel diameter and/or sealing margin widths may be constant and/or vary (e.g., taper, steps, etc.) within one, several or all transfer channel(s) and/or sealing margin(s), respectively, within a particular fluid chamber to further tailor the reactivity and cushioning dynamics.

Figure 3A:
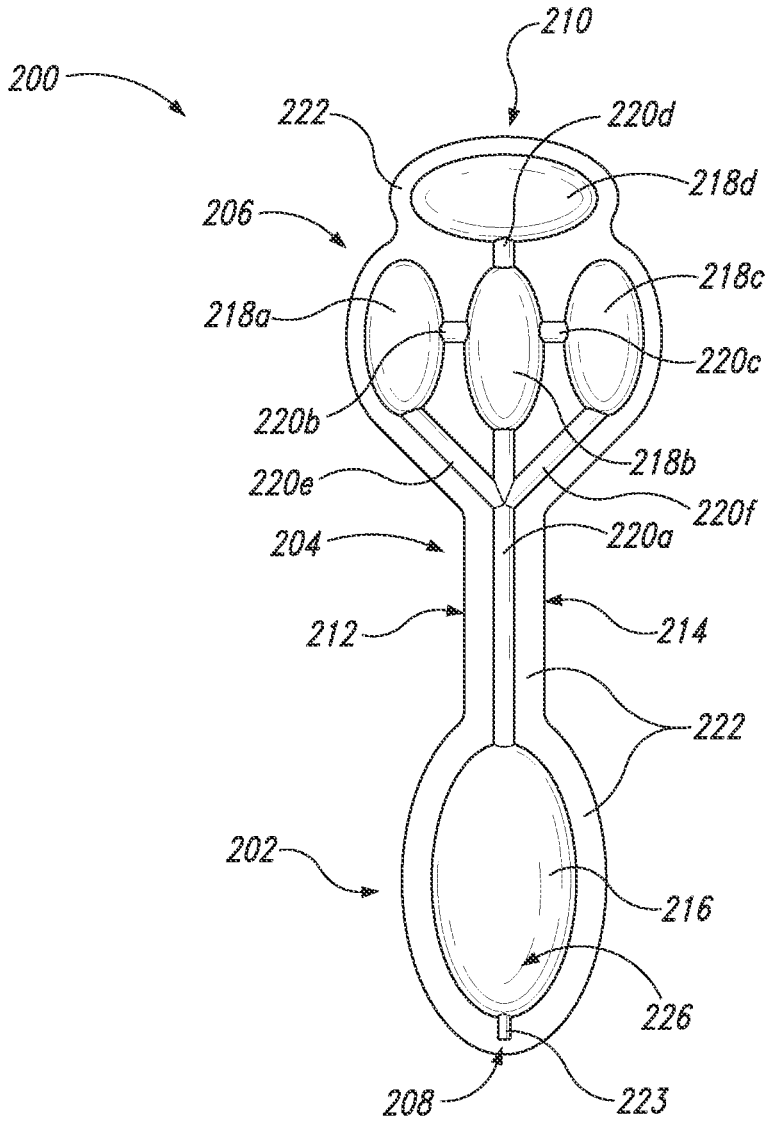
FIGS. 3A and 3B show, according to particular non-limiting aspects of the present invention, a bottom view (A) and a side (profile) view (B) of the alternate fluid (e.g., gel) chamber embodiment 200 of FIG. 2 illustrating how the top of the chamber 200 (including the tops of each reservoir cell and transfer channel) is essentially flat, whereas the bottom of the chamber 200 is contoured, the walls of the five reservoir cells and transfer channels extending downwardly from respective sealing margins and rounding to form contoured bottoms of each of the five reservoir cells.
Figure 3B:
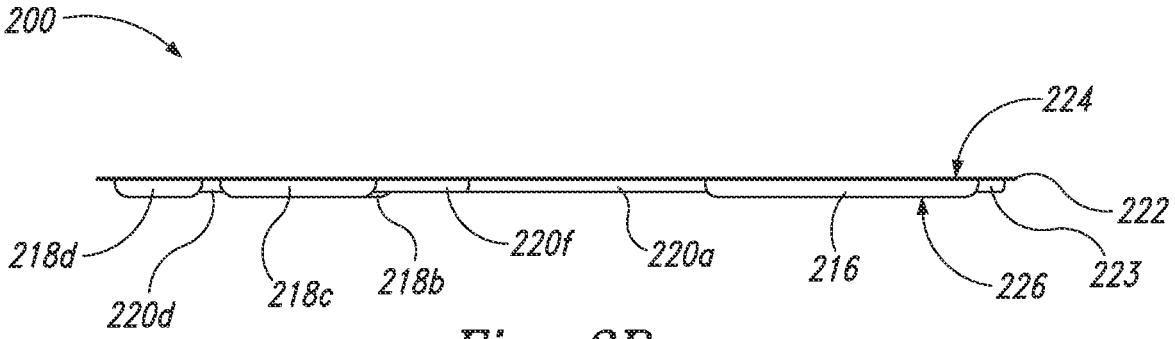
Figure 4:
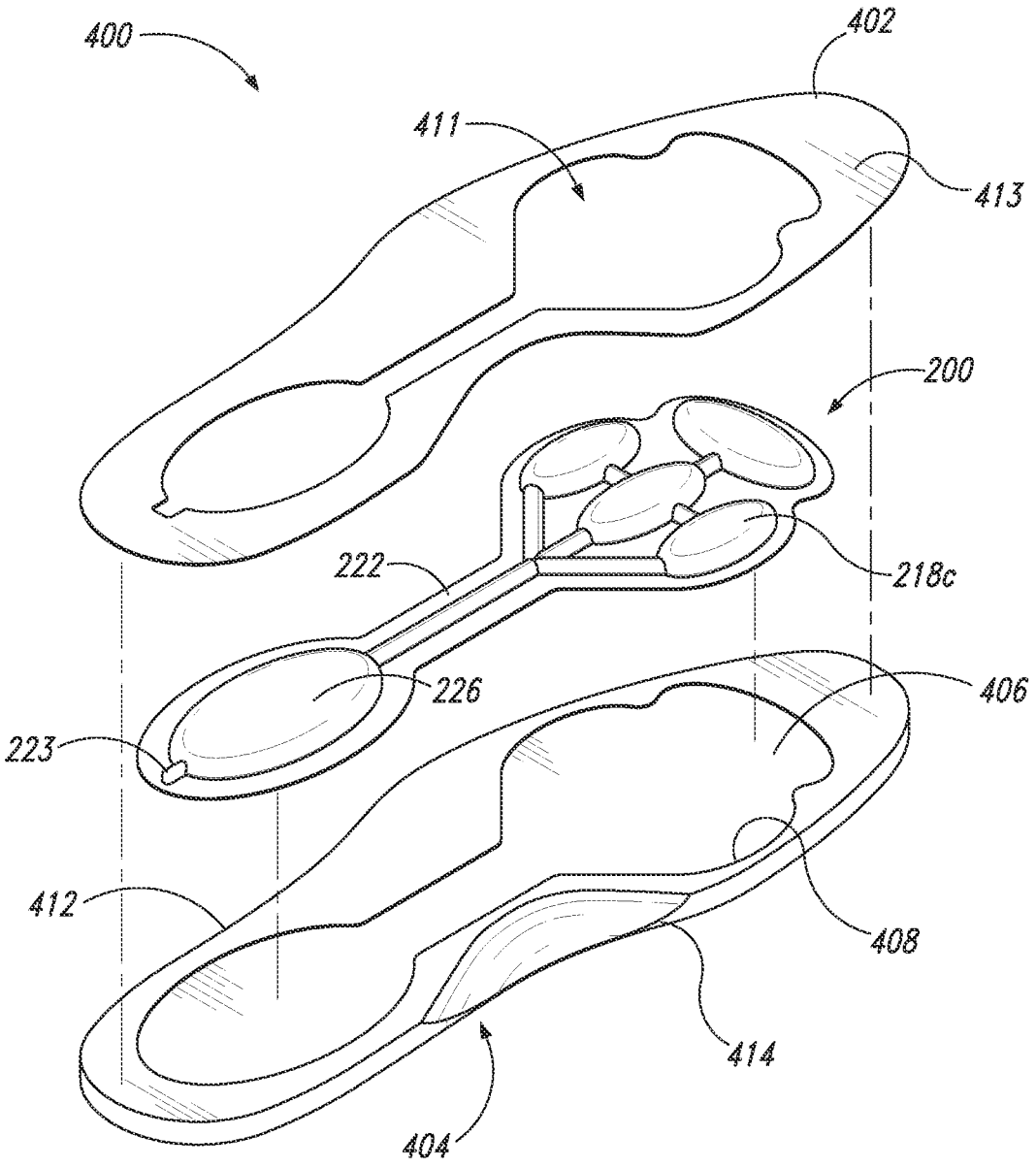
FIG. 4 shows, according to particular non-limiting aspects of the present invention, a bottom perspective, exploded view of a first exemplary insole 400 embodiment comprising the fluid chamber 200 of FIGS. 2 and 3*a* laminated between a laminating piece 402 (having frame 413 and window 411) attached to the bottom of a molded insole portion 404 having an open cavity 406 with margin 408 on its bottom configured to receive the fluid chamber 200, the laminating piece 402 and window 411 being sized and configured to secure the fluid chamber 200 in the cavity 406 while providing visibility of the fluid chamber 200 through the window 411, which is slightly smaller than the margin 408 of the cavity 406.
Figure 5:
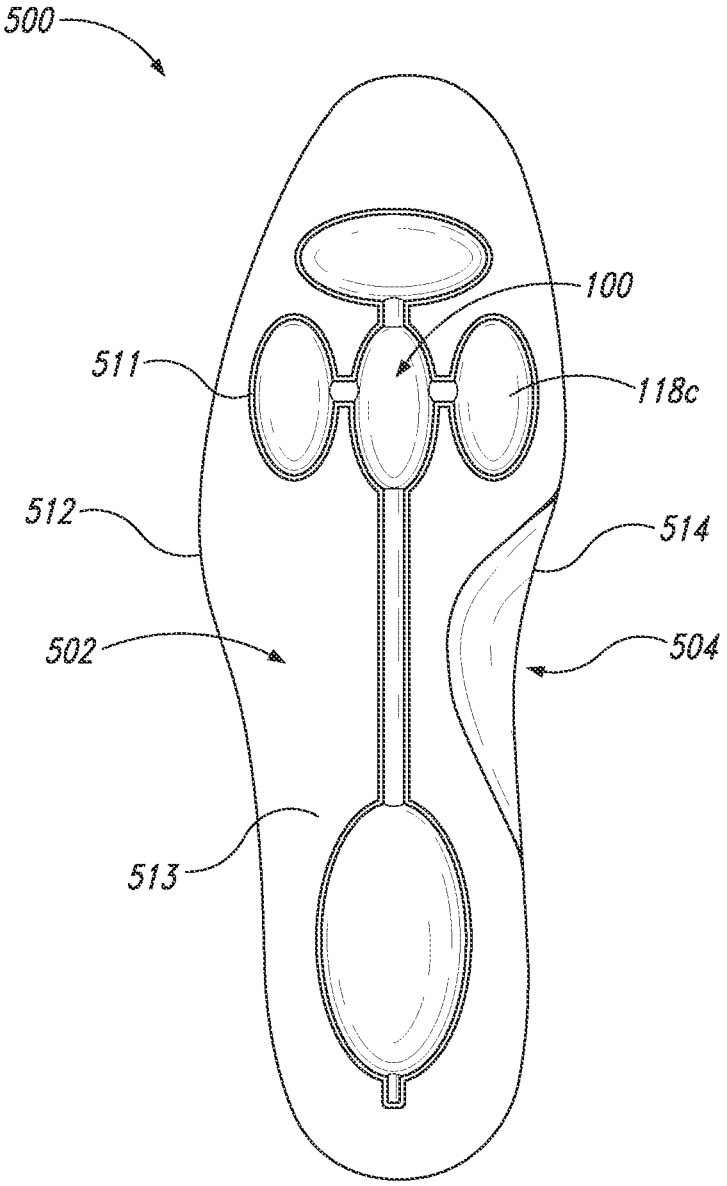
FIG. 5 shows, according to particular non-limiting aspects of the present invention, a bottom view of an alternate exemplary insole 500 embodiment comprising the fluid chamber 100 embodiment of FIG. 1, wherein fluid chamber 100 is visible through the windowed laminating piece 502 that is attached to the bottom of a molded insole portion 504 configured to receive the fluid chamber 100.

While not readily apparent in the top view of FIG. 2, FIGS. 3A and 3B show a bottom view (A) and a side (profile) view (B) of the second fluid chamber embodiment 200, illustrating how the top surface 224 of the fluid chamber 200, including the tops of the five reservoir cells and transfer channels, is essentially flat and substantially coplanar with the sealing margins 222, whereas (as evident in FIG. 3B) the walls of the reservoir cells (e.g., in this embodiment both hindfoot 216 and forefoot 218*a*-*c* reservoirs cells) on the bottom surface 226 of the fluid chamber 200 are contoured below the sealing margins 222 by the walls of each of the five reservoir cells extending downwardly (in rounded or curved fashion) from the respective sealing margins 222, forming an ovoid bottom (e.g., a bottom extending downwardly from the respective margin 222 and having curved or rounded edges near the sealing margins 222) of each of the five reservoir cells. Likewise, as evident in FIG. 3B, the walls of each of the transfer channels (including the diagonal fluid transfer channels 220*e* and 220*f*) extend downwardly, in curved or rounded fashion, from the respective sealing margins 222, forming tubular bottoms of the transfer channels.

Forefoot reservoir cells 218*a*-218*c* are the same or substantially the same volume (fill capacity) and laterally spaced between the lateral 212 and medial side 214, while the forefoot reservoir cell 218*d* is somewhat larger in volume and positioned between the toe end 210 and the three laterally disposed forefoot reservoir cells 218*a*-218*c*. As in the First exemplary embodiment, in this Second exemplary embodiment, the long dimensions of the ovoid hindfoot 216 and forefoot reservoir cells 218*a*-218*c* are longitudinally disposed between the heel end 208 and a toe end 210, whereas the long dimension of ovoid forefoot reservoir cell 218*d* is laterally disposed between the lateral (outer) side 212 and a medial (inner) side 214 of the fluid chamber 200. Use of a plurality of interconnected forefoot fluid reservoirs cells in the fluid chambers of the invention not only provides for balanced dynamic reactivity and cushioning, but also for more targeted pressure relief under the heads of the different metatarsal bones. According to additional aspects, targeted pressure relief is further nuanced by having the long dimension of ovoid forefoot reservoir cell 218*d* laterally disposed under the toe region between the lateral side 212 and a medial side 214 of the fluid chamber 200.

As in the First exemplary embodiment, the main fluid transfer channel 220*a* longitudinally spans the midfoot portion 204 connecting, in fluid exchange communication, the hindfoot reservoir cell 216 with the central forefoot reservoir cell 218*b*. In this embodiment, however, prior to connecting with the central forefoot reservoir cell 218*b*, the main fluid transfer channel 220*a* branches diagonally to also connect directly to outer forefoot reservoir cells 218*a* and 218*c* via the two diagonal fluid transfer channels 220*e* and 220*f*, respectively. The main fluid transfer channel 220*a* thereby connects the hindfoot reservoir cell 216 in direct fluid exchange communication to each of the three laterally disposed forefoot reservoir cells 218*a*-218*c*. As in the First exemplary embodiment, the central forefoot reservoir cell 218*b* in turn is also connected in fluid exchange communication to forefoot reservoir cells 218*a*, 218*c* and 218*d* via secondary transfer channels 220*b*, 220*c* and 220*d*, respectively, the transfer channels collectively (and including the diagonal transfer channels 220*e* and 220*f*) connecting (directly or indirectly) all five fluid reservoir cells in fluid exchange communication.

In this embodiment, as in the first exemplary embodiment 100, the fluid chamber 200 contains a suitable fluid introducible via a fluid fill port 223 into the hindfoot reservoir cell 216 at or near the heel end 208, the fill port 223 then being sealed within the sealing margin 222. Since the hindfoot and forefoot reservoir cells are interconnected in fluid exchange communication, the positioning of the fluid fill port could be into any one of the reservoir cells, or there may be multiple fluid fill ports positioned in or among one or more reservoirs cells, and in each case sealable by respective sealing margin(s). In this embodiment, the fill level of the fluid chamber (including all five of the fluid reservoir cells and transfer channels) is about 85% of the resting (not stretched) fill capacity In this embodiment, as in the First embodiment 100, the fluid chamber 200 is constructed from a transparent thermal polyurethane (TPU), such that the reservoir cells, transfer channels, and any contents thereof are visible. Any suitably flexible resilient material, preferably transparent, may be used.

First Exemplary Insole Embodiment

With reference to FIGS. 1-4, FIG. 4 shows a bottom perspective, exploded view of an exemplary insole 400 having a lateral (outer) side 412 and a medial (inner) side 414, and comprising a fluid chamber 200 (as described in detail above in relation to the second exemplary fluid chamber embodiment 200). A cavity 406, opening on the bottom of a molded insole portion 404, is configured to conform to and receive exemplary fluid chamber 200. In construction of the insole 400, fluid chamber 200 is positioned in the cavity 406 such that its contoured bottom surface 226 (having the rounded bottom fluid reservoir cell walls) faces away from the bottom of molded insole portion 404, and secured into the insole 400 between a laminating piece 402 and the bottom of the molded insole portion 404. The laminating piece 402 has a frame portion 413 defining a window 411, the frame 413 and window 411 being sized and configured to provide for attachment of the frame 413 to the bottom of the molded insole portion 404 surrounding the perimeter 408 of the cavity 406, while allowing for the contoured bottom surface 226 (having the rounded fluid cell walls) to protrude through the window 411. The window 411 is sized and configured to provide visibility of the fluid chamber 200 through the window 411. In this embodiment, the window 411 is slightly smaller (e.g., about 5 mm) than the perimeter 408 of the cavity 406, so that the attached frame 413 not only extends over the bottom of the molded insole portion 404 surrounding the perimeter 408 of the cavity 406, but also over at least a portion of the width of the perimetric sealing margin 222, leaving the contoured bottom of the fluid chamber 200 (including both the fluid reservoir cells and transfer channels) visible within the window when viewed from the bottom of the insole 400.

While the fluid chamber 200 may alternatively be positioned in the cavity 406 of the molded insole portion 404 such that its top (flat) surface 224 faces away from the bottom of molded insole portion 404, such arrangement was determined to be disfavored as the contoured (e.g., rounded) bottom surface 226 of the fluid chamber 200 can be perceived as 'bumpy' or 'lumpy' by a user in such arrangement. Additionally, with respect the contour of the bottom surface of the fluid chamber 200 (i.e., with respect to the shape of the reservoir cell wall extending downwardly from the sealing margins 222), it was empirically determined that having rounded walls of the hindfoot 216 and forefoot 218*a*-*d* reservoir cells provided more optimal fluid transfer rates in and out of the reservoir cells. While not being bound by mechanism, this may reflect improved flow characteristics provided by a curved surface compared to a sharply angled surface (e.g., akin to the reduced energy losses seen in curved vs 90 tee junctions in fluid pipes, due to a reduction in the branching flow loss coefficient; *Journal of Fluid Engineering*, April 2006, 128(6) DOI:10.1115/1.234524).

Alternatively, or in addition, the increased responsiveness provided by positioning the contoured bottom surface 226 (having the rounded fluid reservoir cell walls) to protrude through the window 411 may reflect the enhanced ability of flexible reservoir cells to reactively expand and contract within the window 411, in response to dynamic foot pressure during walking, standing, running, etc.).

Second Exemplary Insole Embodiment

With reference to FIGS. 1-5, FIG. 5 shows a bottom view of a second exemplary insole 500 having a lateral (outer) side 512 and a medial (inner) side 514, and comprising a fluid chamber 100 (as described in detail above in relation to the First exemplary fluid chamber embodiment 100). Construction of the insole is essentially the same as that described above for the First exemplary insole embodiment, except that fluid chamber 100 does not have the diagonal fluid transfer channels 220*e* and 220*f* that are present in fluid chamber 200, such that the frame 513 of the laminating piece 502 extends to cover the areas corresponding to the positions of the diagonal fluid transfer channels 220*e* and 220*f* of fluid chamber 200 that are visible through window 411 of the First exemplary insole embodiment.

According to additional aspects of the present invention, however, there is no requirement that windows of the laminating pieces provide for visibility of all of the elements (e.g., reservoir cells and/or fluid transfer channels) of any particular fluid chamber being used in construction of the insoles, and laminating pieces lacking windows, or having windows restricting visibility to particular elements/portions of fluid chambers 100, 200 may be used in construction of the insoles. For example, laminating piece 502 could be used in the context of either fluid chamber 100 (as in this example) or fluid chamber 200 (as in the First exemplary insole embodiment), but viewing of the diagonal fluid transfer channels 220*e* and 220*f* portions of fluid chamber 200 would be blocked by using laminating piece 502 rather than 402. Additionally, while non-transparent material may be used for construction of the fluid chambers (e.g., 100, 200) in conjunction with windowed (e.g., 402, 502) or windowless laminating pieces, use of transparent material for construction of the fluid chambers (e.g., 100, 200) in conjunction with windowed laminating pieces (e.g., 402, 502) provides for user viewing of the fluid chambers from the bottom of the insoles (e.g., 400, 500). Such viewing allows the user, or potential user/customer to view and appreciate the dynamic fluid transfer aspects of the fluid chamber (e.g., 100, 200), enhancing marketing of the fluid chambers (e.g., 100, 200) and insoles (e.g., 400, 500). Moreover, visibility and appreciation of fluid dynamics may be enhanced by inclusion of an indicator agent (e.g., colorimetric, fluorescent, chromogenic, etc., agent) in the fluid (e.g., in a clear or translucent fluid (e.g., gel)) to aid visualization of fluid transfer dynamics within the fluid chambers (e.g., 100, 200).

A cavity 506 (not visible in FIG. 5) opening on the bottom of a molded insole portion 504, is configured to conform to and receive exemplary fluid chamber 100. In construction of the insole 500, fluid chamber 100 is positioned in the cavity 506 such that its contoured (e.g., rounded) bottom surface 126 faces away from the bottom of molded insole portion 504, and secured into the insole 500 between a laminating piece 502 and the bottom of the molded insole portion 504. The laminating piece 502 has a frame portion 513 defining a window 511, the frame 513 and window 511 being sized and configured to provide for attachment of the frame 513 to the bottom of the molded insole portion 504 surrounding the perimeter 508 of the cavity 506, while allowing for the contoured bottom surface 226 (having the rounded fluid reservoir cell walls) to protrude through the window 511. The window 511 is sized and configured to provide visibility of the fluid chamber 100 through the window 511. In this embodiment, the window 511 is slightly smaller (e.g., about 5 mm) than the perimeter 508 of the cavity 506, so that the attached frame 513 not only extends over the bottom of the molded insole portion 504 surrounding the perimeter 508 of the cavity 506, but also over at least a portion of the width of the perimetric sealing margin 122, leaving the contoured bottom of the fluid chamber 100 (including both the fluid reservoir cells and transfer channels) visible within the window when viewed from the bottom of the insole 500.

While the fluid chamber 100 may alternatively be positioned in the cavity 506 of the molded insole portion 504 such that its top (flat) surface 224 faces away from the bottom of molded insole portion 504, such arrangement was determined to be disfavored as the reservoir cells of the contoured (e.g., rounded) bottom surface 226 of the fluid chamber 100 can be perceived as 'bumpy' or 'lumpy' by a user in such an arrangement. Additionally, with respect the contour of the bottom surface of the fluid chamber 100 (i.e., with respect to the shape of the reservoir cell wall extending downwardly from the sealing margins 122) it was empirically determined that having rounded walls of the hindfoot 116 and forefoot 118*a-d* reservoir cells provided more optimal fluid transfer rates in and out of the reservoir cells. While not being bound by mechanism, this may reflect improved flow characteristics provided by a curved surface compared to a sharply angled (e.g., 90°) surface (e.g., akin to reduced energy losses reported in the context of curved vs 90° tee junctions in fluid pipes, due to a reduction in the branching flow loss coefficient (e.g., see *Journal of Fluid Engineering*, April 2006, 128(6) DOI:10.1115/1.234524)).

Alternatively, or in addition, the increased responsiveness provided by positioning the contoured bottom surface 226 (having the rounded fluid cell walls) to protrude through the window 511 may reflect the enhanced ability of flexible reservoir cells to reactively expand and contract within the window 511, in response to dynamic foot pressure during walking, standing, running, etc.).

Shoe and Footwear Embodiments

In additional embodiments, the fluid chambers (e.g., 100, 200, etc.), insoles or orthoses comprising same (e.g., 400, 500, etc.), may be integrated into a shoe (e.g., sneakers, athletic shoes, walking shoes, hiking shoes, tennis shoes, etc.), boot, or other form of footwear. For example, insoles or orthoses comprising the fluid chambers of the invention may be inserted (e.g., reversibly) into shoes or other forms of footwear. Alternatively, the fluid chambers may be an integral (built-in) part of a shoe or other form of footwear as constructed.

Seat Cushion Embodiments

Additional embodiments provide multi-reservoir fluid chambers as part of a cushion (seat cushion) for use on chairs, benches, in cars, etc.

Exemplary seat cushioning embodiments provide a cushioning system, comprising: a fluid chamber having top and bottom surfaces, rearward, mid, and forward portions extending between a front end and a back end, and having a left side and a right side; at least one flexible fluid reservoir cell in each of the rearward portion and the forward portion; and at least one main fluid transfer channel spanning the mid portion and connecting, in fluid exchange communication, the at least one flexible fluid reservoir cell in the rearward portion with the at least one flexible fluid reservoir cell in the forward portion.

In the cushioning systems, the top surface of the fluid chamber may be flat or substantially flat, and/or the bottom surface of the fluid chamber may be contoured, extending downwardly away from the top surface. The fluid chamber may comprise sealed margins defining the at least one rearward flexible fluid reservoir cell, and/or the at least one forward flexible fluid reservoir cell, and/or the at least one main fluid transfer channel. Preferably, the top surface of the fluid chamber is substantially coplanar with the sealing margins, and wherein the bottom of the fluid chamber is contoured below the sealing margins by the walls of each of the at least one forefoot and/or hindfoot reservoir cells extending downwardly from the respective sealing margins.

In the cushioning systems, the forward portion of the fluid chamber may comprise a plurality of forefoot fluid reservoir cells interconnected directly or indirectly by secondary forward fluid transfer channels to be in fluid exchange communication, such that the interconnected forward fluid reservoir cells are, directly or indirectly, in fluid exchange communication with the at least one rearward fluid reservoir cell via the at least one main fluid transfer channel. The fluid chamber, for example, may comprise at least two flexible fluid reservoir cells in the forward portion interconnected by at least one secondary forward fluid transfer channel, such that the at least two interconnected forward fluid reservoir cells are, directly or indirectly, in fluid exchange communication with the at least one rearward fluid reservoir cell via the at least one main fluid transfer channel. The at least two forward fluid reservoir cells may be positioned laterally between the left and right sides of forward portion of the fluid chamber, and laterally interconnected by the at least one secondary forward fluid transfer channel. The fluid chamber may, for example, comprise at least three to ten, or more, forward reservoir cells interconnected directly or indirectly by the secondary forward fluid transfer channels, such that the at least three interconnected forward fluid reservoir cells are, directly or indirectly, in fluid exchange communication with the at least one rearward fluid reservoir cell via the at least one main fluid transfer channel.

In the cushioning systems, the rearward portion of the fluid chamber may comprise a single rearward fluid reservoir cell, and wherein the forward portion may comprise at least four forward fluid reservoir cells interconnected directly or indirectly by the secondary forward fluid transfer channels, such that the at least four interconnected forward fluid reservoir cells are, directly or indirectly, in fluid exchange communication with the at least one rearward fluid reservoir cell via the at least one main fluid transfer channel. Three of the at least four interconnected forward fluid reservoir cells may be positioned laterally between the left and right sides of forward portion of the fluid chamber, and wherein one of the at least four interconnected forward fluid reservoir cells may be positioned between the front end of the fluid chamber and the three laterally disposed interconnected forward fluid reservoir cells within the forward portion.

In the cushioning systems, the fluid chamber preferably comprises a single main fluid transfer channel spanning the mid portion.

In the cushioning systems, the fluid chamber may comprise a single main fluid transfer channel spanning the mid portion and connecting directly to the central cell of three laterally disposed interconnected forward fluid reservoir cells. The main fluid transfer channel spanning the mid portion may branch to connect directly to each of the three laterally disposed interconnected forward fluid reservoir cells. The branches may comprise, for example, two diagonal fluid transfer channels connecting the main fluid transfer channel directly to the outer cells of the three laterally disposed interconnected forward fluid reservoir cells.

In the cushioning systems, the combined volume (resting fluid capacity) of the at least one rearward fluid reservoir cell(s) may be the same, smaller or larger than the combined volume of the at least one forward fluid reservoir cell(s). In the cushioning systems, the fluid chamber may comprise a plurality of forward fluid reservoir cells of more than one volume.

In operative embodiments of the cushioning systems, the fluid chamber may comprise a fluid (e.g., gel, such as a liquid silicone gel).

The cushioning systems may be in the form of a transportable seat cushion for use on a chair, bench, car seat, etc. Alternatively, the cushioning systems may be inserted into or otherwise integrated, reversibly or irreversibly into a chair bench or car seat (e.g., built-in).

The cushioning systems may comprise one, or a plurality of the fluid chambers.

Additionally provided are methods of making seat cushions, comprising incorporating the cushioning system(s) into a seat cushion or chair, bench, car seat, etc.

The invention claimed is:

1. A cushioning system, comprising an insole having:

a polyurethane fluid chamber having top and bottom surfaces, hindfoot, midfoot, and forefoot portions extending between a heel end and a toe end, and having a lateral (outer) side and a medial (inner) side;

a flexible fluid reservoir cell centered between the lateral and medial sides in the hindfoot portion;

three flexible fluid reservoir cells in the forefoot portion positioned laterally between the lateral and medial sides, and laterally interconnected by secondary forefoot fluid transfer channels; and a single main fluid transfer channel spanning the midfoot portion from the hindfoot portion to the forefoot portion and having two branches, connecting the main fluid transfer channel directly to the outer cells of the three laterally interconnected forefoot fluid reservoir cells, in the forefoot portion to connect, in fluid exchange communication, the main fluid transfer channel to each of the three laterally interconnected forefoot flexible fluid reservoir cells, such that the three laterally interconnected forefront fluid reservoir cells are each in direct fluid exchange communication with the centered hindfoot fluid reservoir cell via the main fluid transfer channel to provide a reactive fluidic network, wherein the diameter of the single main fluid transfer channel, including of the branches thereof, is a value in a range of 5 mm to 10 mm, and wherein the fluid chamber is filled with a liquid silicone gel to a level of 80% to 85% of a resting (unstretched) fluid capacity of all of the fluid reservoir cells and the fluid transfer channels, collectively.

2. The cushioning system of claim 1, wherein at least one of the three laterally interconnected forefoot flexible fluid reservoir cells is positioned at or within a ball of the foot portion of the forefoot position of the fluid chamber.

3. The cushioning system of claim 1, wherein the top surface of the fluid chamber is flat or substantially flat, and wherein the bottom surface of the fluid chamber is contoured, extending downwardly away from the top surface.

4. The cushioning system of claim 1, wherein the fluid chamber comprises sealed margins defining the hindfoot flexible fluid reservoir cell, and/or the three laterally interconnected forefoot flexible fluid reservoir cells, and/or the main fluid transfer channel and/or the secondary forefoot fluid transfer channels.

5. The cushioning system of claim 4, wherein the top surface of the fluid chamber is substantially coplanar with the sealing margins, and wherein the bottom of the fluid chamber is contoured below the sealing margins by the walls of the hindfoot and/or the three laterally interconnected forefoot reservoir cells extending downwardly from the respective sealing margins.

6. The cushioning system of claim 1, wherein the forefoot portion comprises at least three to ten forefoot reservoir cells interconnected directly or indirectly by a plurality of the secondary forefoot fluid transfer channels, such that the interconnected forefront fluid reservoir cells are, directly or indirectly, in fluid exchange communication with the hindfoot fluid reservoir cell via the main fluid transfer channel.

7. The cushioning system of claim 6, wherein the hindfoot portion comprises a single hindfoot fluid reservoir cell, and wherein the forefoot portion comprises at least four forefoot fluid reservoir cells interconnected directly or indirectly by the secondary forefoot fluid transfer channels, such that the at least four interconnected forefront fluid reservoir cells are, directly or indirectly, in fluid exchange communication with the hindfoot fluid reservoir cell via the main fluid transfer channel.

8. The cushioning system of claim 7, wherein three of the at least four interconnected forefoot fluid reservoir cells are positioned laterally between the lateral and medial sides of forefoot portion of the fluid chamber, and wherein one of the at least four interconnected forefoot fluid reservoir cells is positioned between the toe end of the fluid chamber and the three laterally disposed interconnected forefoot fluid reservoir cells within the forefoot portion.

9. The cushioning system of claim 1, wherein the branches comprise two diagonal fluid transfer channels connecting the main fluid transfer channel directly to the outer cells of the three laterally disposed interconnected forefoot fluid reservoir cells.

10. The cushioning system of claim 1, wherein the combined volume (resting fluid capacity) of the hindfoot fluid reservoir cell(s) is the same or smaller than the combined volume of the forefoot fluid reservoir cell(s).

11. The cushioning system of claim 1, comprising a plurality of forefoot fluid reservoir cells of more than one volume.

12. The cushioning system of claim 1, as part of an insole, orthosis, or shoe.

13. A method of making footwear, comprising incorporating a cushioning system according to claim 1 into an insole.

14. The method of claim 13, wherein incorporating comprises laminating the cushioning system into the insole.

15. The cushioning system of claim 1, wherein the midfoot portion of the fluid chamber has no fluid reservoir cells.

16. The cushioning system of claim 1, wherein the diameter of the single main fluid transfer channel, including of the branches thereof, is 7 mm, and wherein the fluid chamber is filled with a liquid to a level of 80% to 85% of a resting (unstretched) fluid capacity of all of the fluid reservoir cells and the fluid transfer channels, collectively.

* * * * *